United States Patent [19]

Pahnke et al.

[11] 4,073,180

[45] Feb. 14, 1978

[54] RING FORGING APPARATUS FOR FORMING AND ENLARGING LARGE RINGS

[75] Inventors: Hans J. Pahnke; Hans-Albert Schubert, both of Dusseldorf, Germany

[73] Assignee: Pahnke Engineering G.m.b.H. & Co. KG, Dusseldorf, Germany

[21] Appl. No.: 669,902

[22] Filed: Mar. 24, 1976

[30] Foreign Application Priority Data

Apr. 3, 1975 Germany ..... 2514898

[51] Int. Cl.[2] ..... B21J 9/12

[52] U.S. Cl. ..... 72/453.01; 72/455; 100/258 A

[58] Field of Search ..... 72/453.06, 455, 451, 72/453.01, 453.18; 100/231, 258 R, 258 A

[56] References Cited

U.S. PATENT DOCUMENTS

| | | | |
|---|---|---|---|
| 2,221 | 8/1841 | Houpt | 100/258 R |
| 3,247,783 | 4/1966 | Hammon | 100/231 |
| 3,524,405 | 8/1970 | Garrison | 72/451 |
| 3,884,142 | 5/1975 | Jonsson | 72/455 |

*Primary Examiner*—C.W. Lanham
*Assistant Examiner*—Gene P. Crosby
*Attorney, Agent, or Firm*—Buell, Blenko & Ziesenheim

[57] ABSTRACT

Apparatus is provided for enlarging metal rings using a hydraulic press having a piston and anvil including a pair of generally parallel arms adapted to fit between the piston and anvil and be acted on intermediate their ends. The arms are maintained in a parallel relationship by a linkage arrangement. A pair of opposed work surfaces at one end of said parallel arms outside the press are adapted to receive a ring to be enlarged. A compensating hydraulic cylinder between the other ends of said parallel arms act between said ends to maintain said arms in parallel relationship with minimum pressure on said parallel linkage.

10 Claims, 3 Drawing Figures

RING FORGING APPARATUS FOR FORMING AND ENLARGING LARGE RINGS

This invention relates to ring forging apparatus for forming and enlarging large rings and particularly to a press and apparatus for forging rings of great weight and large dimensions.

Rings of great weight and dimensions are generally pierced in forging presses using an arbor, and widened or enlarged to the extent permissible by the maximum height of the tool mounting height of the press. The production of rings with larger dimensions must be done with special equipment. Various ring rolling presses and widening presses have been proposed. Examples of such ring rolling devices are to be found in U.S. Pat. No. 3,695,079 and British Pat. No. 1,265,603.

These large rings, with individual weights of 100,000 to 200,000 kgs., are produced only in small numbers and the use of such specialized and expensive ring rolling presses is not justified to most producers of rings. As a result several devices have also been suggested which can be installed into forging presses in such a way as to position the tools outside of the area of the press beams. This, of course, eliminates the limitation on ring size made by the tool mounting height of the press. Such a device is, for example, described in German patent publication No. 2,247,481. The device of that patent publication is suitable for forging presses whose lower beams are considerably longer than the upper press assembly. However, a precise guidance of the workpiece in the center of the tool is an absolute essential, since a change of the lever ratio between the center of the press and the center of the forming forces, on the one side, and the center of the press and the compensating cylinder, on the other side, cause an angular position of the upper tool resulting in an eccentric load on the press. This is not desirable. The application of a mechanical support bearing on the side opposite from the tool is, for the same reasons, only feasible when very short strokes or minimal forming forces are encountered.

The present invention is designed to solve these problems and to make it possible to enlarge or widen the rings independently of the width of the press beam. The invention provides apparatus which is self-compensating as far as eccentric forces in the center of the tool are concerned, which eccentric forces are created when the workpiece is not precisely centered.

This invention provides a device for enlarging and widening out metal rings designed to be used in a hydraulic press and comprising a pair of tool beams connected by a parallel linkage, one side protruding from the hydraulic press, the other side having a compensating hydraulic cylinder, said tool beams being connected by said parallel linkage in such manner that angular positioning or tilting of the beams in the press is prevented. Preferably the load of the parallel linkage during the work stroke phase is measured and the results of the measurements used to control the pressure in the compensating hydraulic cylinder. The compensating pressure is preferably created by a separate pump equipped with an adjustable pressure limiting valve to provide a variable controlled pressure. It is also preferably arranged that the pressure limiting valve in coordination with the work stroke of the press causes the compensating cylinder to operate the withdrawal stroke of the upper beams of the inventive device.

In the foregoing general description of this invention certain objects, purposes and advantages are set forth. Other objects, purposes and advantages of this invention will be apparent from a consideration of the following description and the accompanying drawings in which.

Figure 1:
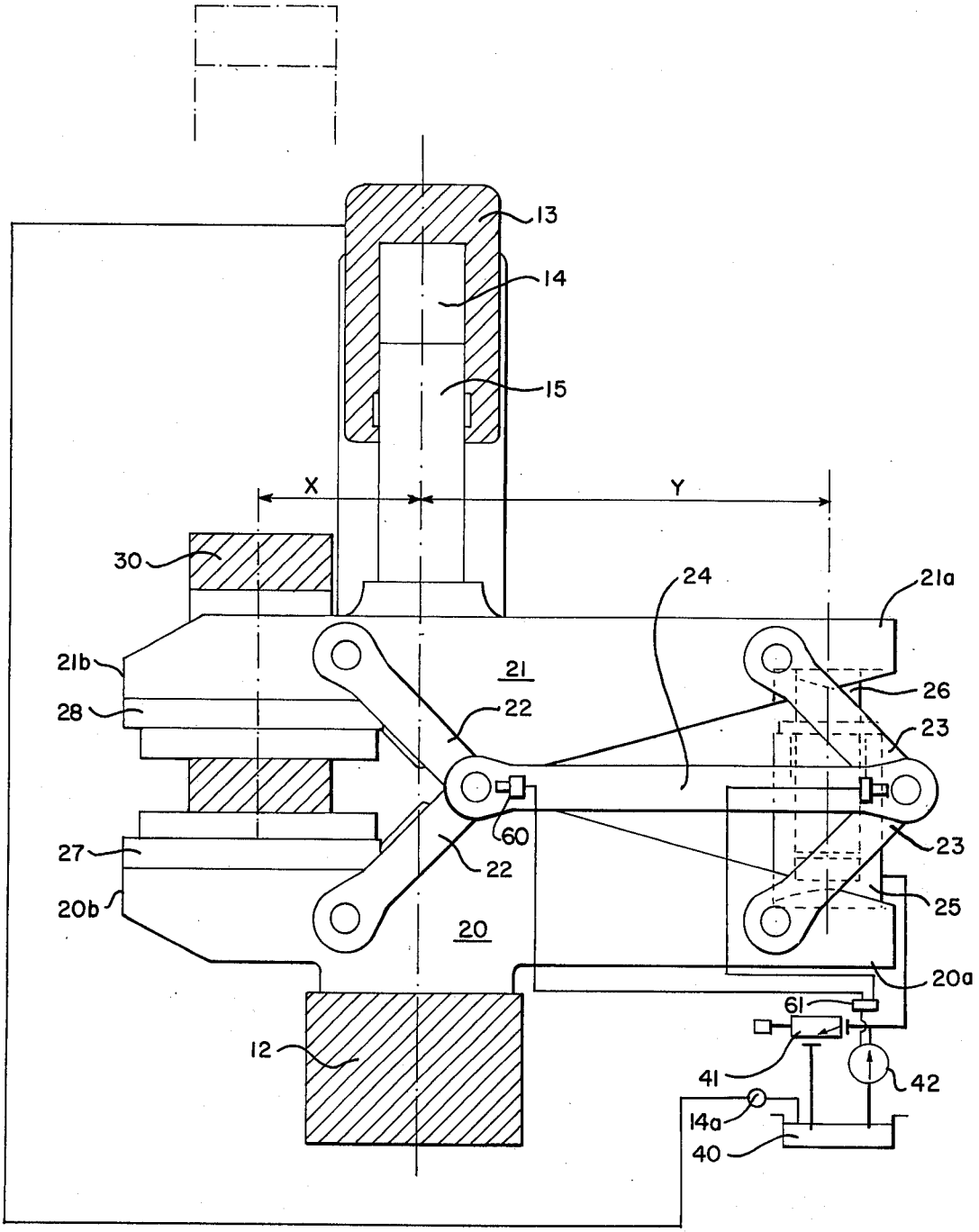
FIG. 1 is a side elevational view of an apparatus for widening out rings according to this invention.
Figure 2:
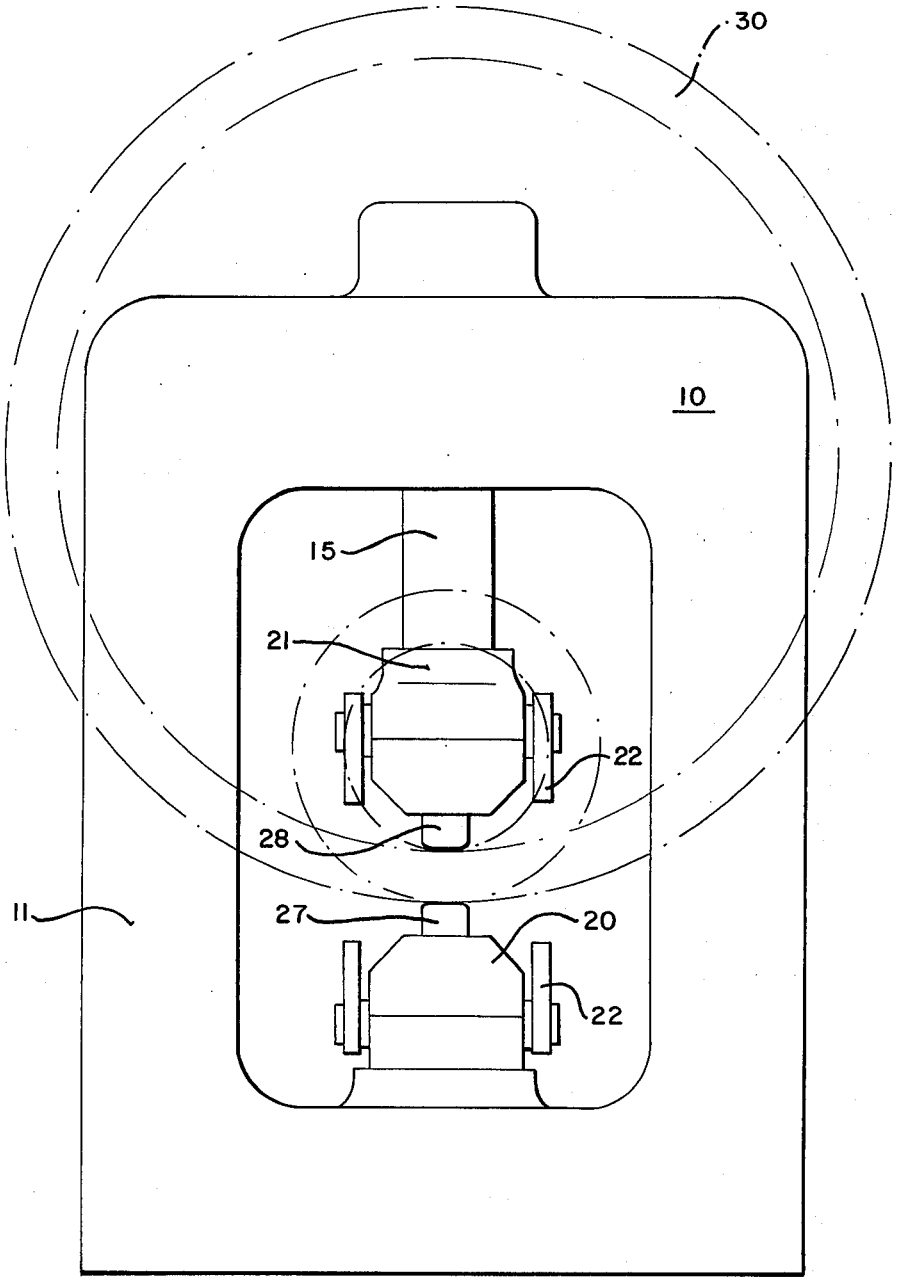
FIG. 2 is an end elevational view of the apparatus of FIG. 1.

Referring to the drawings there is illustrated a hydraulic press 10 having a main frame 11 including a forwardly projecting anvil 12 at the bottom and a forwardly projecting arm 13 carrying a cylinder 14 and piston 15 vertically above anvil 12. The cylinder 14 receives fluid from a pump **14*a***. This structure is convention in hydraulic presses and any comparable press arrangement may be used.

The particular apparatus of this invention used in combination with the hydraulic press above includes a lower tool carrier 20 and an upper tool carrier 21 mounted on forward scissors links 22 and rear scissors links 23 connected by a parallel drive link 24. This scissors link assembly causes the two tool carriers 20 and 21 to move in parallel toward and away from each other. A compensating counter pressure cylinder 25 and piston 26 are mounted between two ends **20*a* and 21*a* of the tool carriers 20 and 21. The other ends 20*b* and 21*b* of the tool carriers 20 and 21 are provided with work jaws 27 and 28**.

The apparatus is positioned in the hydraulic press 10 with lower tool carrier 20 anvil 12 and piston 15 bearing on upper tool carrier 21 in such way that the proportions of the distance X of the center line of the press to the center line of the work to the distance Y of the center line of the press to the center line of the compensating cylinder 25 correspond approximately to the ratio of the work surface of the compensating piston 26 to that of the main piston 15.

The distance ratio Y:X must be as large as the dimensions of the press will allow since the maximum attainable press force of cylinder 14 usable as an effective forming force is dependent upon this ratio and the strength of the parallel system.

If, during the forging of ring 30, the distance X of the center of forces to the axis of the press changes, compensating forces are created in the parallel bars 22, 23 and 24 which prevents angular positioning of the tool beams 20 and 21 and thus protects the press from eccentric loading.

Figure 3:
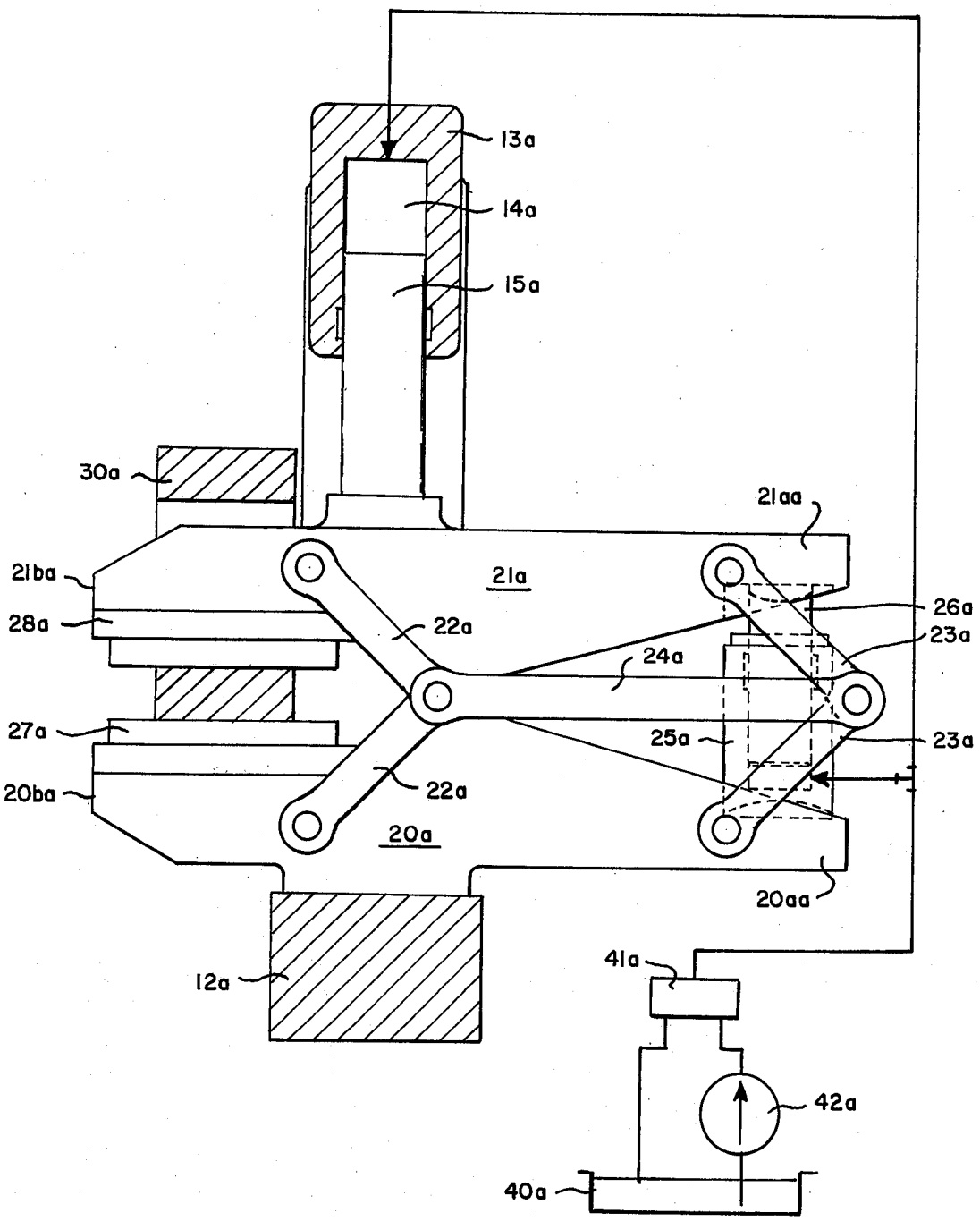
FIG. 3 is a side elevational view of a second embodiment of apparatus according to this invention.

The compensating cylinder 25 may be connected with the work cylinder 14 to a single source of hydraulic fluid (as shown in FIG. 3) or alternatively it may have its own separate hydraulic system (as shown in FIG. 1). Such a separate hydraulic system is illustrated in FIG. 1. In this particular system, hydraulic fluid contained in reservoir 40 is delivered to cylinder 25 by pump 41 acting through variable pressure limiting valve 42. Valve 42 may be controlled by measuring the forces created in the parallel linkage 22, 23 and 24 by means of gauges, pressure cells, strain gauges, etc. 60 and by means of known electro hydraulic controllers 61 operated by the current generated from such measuring means. In this case the forces created in the beams 20 and 21 are transmitted to the parallel linkage where they are measured and valve 42 is altered to change the pressure in cylinder 25 so that eccentricity is avoided.

In FIG. 3 I have illustrated a second embodiment similar to FIG. 1 but having a common source 40*a* for both cylinders 25*a* and 13*a*. Like parts of this figure are given the same numerals as in FIG. 1 with the suffix *a*.

In the foregoing specification certain preferred embodiments and practices of this invention have been illustrated and described, however, it will be obvious that this invention may be otherwise embodied within the scope of the following claims.

We claim:

1. In combination a hydraulic press, having a frame, an anvil member and a press piston movable toward said anvil, a pair of generally parallel arms adapted to fit between said piston and anvil and be acted thereon intermediate the ends of said arms by said piston, said arms being connected by a parallel linkage maintaining said arms in generally parallel relationship, a pair of opposed work surfaces at one end of said parallel arms adapted to receive a ring to be enlarged and a compensating hydraulic cylinder between the other ends of said parallel arms acting between said ends to maintain said arms in parallel with minimum pressure on said parallel arms.

2. The combination claimed in claim 1 wherein the compensating hydraulic cylinder and press piston receive fluid from a common source.

3. The combination claimed in claim 2 wherein the ratio of the distance between the center line of the press piston and the center line of the work and the distance between the center line of the press piston and the center line of the compensating piston is substantially the same as the ratio of the work surface of the press piston and the work surface of the compensating piston.

4. The combination claimed in claim 1 wherein the compensating piston receives fluid from a source separate from the press cylinder through a controllable pressure limiting valve.

5. The combination claimed in claim 4 wherein means responsive to variations in pressure in the parallel linkage controls the pressure limiting valve.

6. An apparatus for enlarging metal rings comprising a pair of generally parallel arms adapted to fit between a press piston and anvil of a hydraulic press and be acted on intermediate their ends between said anvil and piston, said arms being connected by a parallel linkage maintaining said arms in generally parallel relationship, a pair of opposed work surfaces at one end of said parallel arms adapted to receive a ring to be enlarged and a compensating hydraulic cylinder between the other ends of said parallel arms acting between said ends to maintain said arms in parallel with minimum pressure on said parallel arms.

7. An apparatus as claimed in claim 6 wherein the compensating hydraulic cylinder and press piston receive fluid from a common source.

8. An apparatus as claimed in claim 6 wherein the compensating hydraulic cylinder receives fluid from a source separate from the press cylinder through a controlled pressure limiting valve.

9. An apparatus as claimed in claim 8 wherein means responsive to pressure variations in the parallel linkage controls the pressure limiting valve.

10. An apparatus as claimed in claim 9 wherein the means responsive to pressure variations includes a strain gauge.

* * * * *